United States Patent [19]

Nanba et al.

[11] Patent Number: 4,778,166

[45] Date of Patent: Oct. 18, 1988

[54] JAW FOLDING DEVICE FOR A JAW CYLINDER OF JAW-TYPE FOLDER

[75] Inventors: Takeo Nanba; Mitsuo Kitai, both of Kanagawa, Japan

[73] Assignee: Kabushikigaisha Tokyo Kikai Seisakusho, Tokyo, Japan

[21] Appl. No.: 3,395

[22] Filed: Jan. 14, 1987

[30] Foreign Application Priority Data

Jan. 22, 1986 [JP] Japan ..... 61-7492[U]

[51] Int. Cl.[4] ..... B42C 1/04

[52] U.S. Cl. ..... 270/47; 493/428

[58] Field of Search ..... 270/47; 101/409; 493/424–429, 434, 435, 442, 454

[56] References Cited

U.S. PATENT DOCUMENTS

| | | | |
|---|---|---|---|
| 820,675 | 5/1906 | Seymour | 493/428 |
| 2,435,881 | 2/1948 | Faeber | 493/429 |
| 2,950,705 | 8/1960 | Berry | 493/426 |
| 3,765,671 | 10/1973 | Blomberg | 493/428 |
| 4,352,671 | 10/1982 | Petersen | 493/424 |

FOREIGN PATENT DOCUMENTS

| | | | |
|---|---|---|---|
| 435594 | 10/1926 | Fed. Rep. of Germany | 493/428 |
| 3130689 | 10/1980 | Fed. Rep. of Germany | 101/409 |
| 870799 | 6/1961 | United Kingdom | 493/428 |

*Primary Examiner*—E. H. Eickholt

*Attorney, Agent, or Firm*—Foley, Lardner, Schwartz, Jeffery, Schwaab, Mack, Blumenthal & Evans

[57] ABSTRACT

This invention relates to a jaw folding device for a jaw cylinder of jaw-type folder which can be switched between a correct run mode for performing a duplicate folding and a straight run mode performing an ordinary folding. This jaw folding device comprises a controllable jaw plate which is secured to a controllable jaw plate shaft, a fixed jaw plate arranged so as to face to the controllable jaw plate, an actuating means for actuating the controllable jaw plate between its opening and closing positions in synchronism with a base machine, and a fixing means for fixing the controllale jaw plate in its opening position where a paper is not picked up.

3 Claims, 4 Drawing Sheets

JAW FOLDING DEVICE FOR A JAW CYLINDER OF JAW-TYPE FOLDER

BACKGROUND OF THE INVENTION

1. Field of the Invention

The present invention generally relates to a jaw folding device of a jaw-type folder which is suitable for roll paper. Particulary, the present invention relates to a jaw folding mechanism of a jaw cylinder of this jaw folding device for jaw folding papers to be printed to form a folded print. More particularly, the present invention relates to a jaw folding device for a jaw cylinder of a jaw-type folder which can be switched between a correct run mode for performing a duplicate folding and a straight run mode for performing an ordinary folding.

2. Description of the Prior Art

Conventional jaw folding devices for a jaw cylinder of a jaw folding device have been shown in "Offset Print" (first print issue, pp. 196 to pp. 200) published by Nippon Insatsu Shinbun-Sha (Japan Print Newspaper Company) on June 25, 1984; "Introduction of Printing Machine" (first edition print, pp. 64 to pp. 67) published by Insatsu Gakkai on Feb. 7, 1979; Japanese Patent Publication No. Sho. 47-51740; and Japanese Patent Publication No. Sho. 52-12612.

In such prior art, a jaw cylinder is provided with a pair of jaw folding devices in such a manner that they are symmetrically arranged on the circumferential surface of the cylinder about the axis of the cylinder. Under a straight run mode (ordinary folding mode), these jaw folding devices repeat opening and closing motions, so that each device performs jaw folding and feeding work of a paper section. On the other hand, under a correct run mode (duplicate folding mode), a previously printed paper (first section) is firstly wound around a folding cylinder and kept in such waiting state for a while, and secondly lapped with a subsequently printed paper (second section). Then these first and second sections are jaw-folded and fed to the succeeding step. Accordingly, under the correct run mode jaw folding action will be decreased in proportion to the number of waiting operations of the first section rather than the straight run mode. In detail, under the straight run mode two jaw folding devices on the cylinder alternatively perform jaw-folding action as the cylinder revolves. On the other hand, under the correct run mode only one of the jaw folding devices is actuated to perform the jaw folding action.

Therefore, in conventional manner the non-actuated one is removed from the cylinder or a jaw plate is removed from the non-actuated device during the correct run mode. This removing operation is conducted when the mode is switched from the straight run mode to the correct run mode.

However, this removing operation is complicated and thus causes the working efficiency and the operation rate of machine to become poor.

SUMMARY OF THE INVENTION

It is an object of the present invention to provide an improved jaw folding device for a jaw cylinder of a jaw-type folder which can improve the working efficiency and the operation rate of machine.

Another object of the present invention is to provide an improved jaw folding device for a jaw cylinder of a jaw-type folder which can easily and quickly perform the switching operation between the straight run mode and the correct run mode.

A further object of the present invention is to provide an improved jaw folding device for a jaw cylinder of a jaw-type folder which is free from the necessity of removing a jaw plate of the jaw folding device or the whole body of the jaw folding device from the jaw cylinder when the run mode is switched from the straight run mode to the correct run mode.

To accomplish the above described objects, according to the present invention, a jaw folding device for a jaw cylinder of a jaw-type folder comprising a controllable jaw plate, a fixed jaw plate arranged so as to face the controllable jaw plate, and an actuating means for actuating the controllable jaw plate between its opening and closing positions in synchronism with a base machine; is further provided with a fixing means for fixing the controllable jaw plate in its opening position where a paper is not picked up.

Ordinarily, two sets of this jaw folding device are arranged in grooves formed in a jaw cylinder. The controllable jaw plate of either one of the jaw folding devices is isolated from the fixed jaw plate and fixed in the position by means of the fixing means during the correct run mode. According to this operation, one of the jaw folding devices is kept in its opening position where this jaw folding device is prohibited from its jawing operation. This jaw folding device does not jaw the section protruded from a folding cylinder, so that this section is wound around the folding cylinder as the first section.

Succeedingly, this first section is lapped with the succeeding section (second section). These lapped sections are subjected to the jaw folding operation of the other jaw folding device which is actuated. These folded sections are fed to the next step.

Under the straight run mode all the jaw folding devices are free from the fixing means.

The above and other objects and features of the invention will apper more fully hereinafter from a consideration of the following description taken in connection with the accompanying drawing wherein one example is illustrated by way of example.

DETAILED DESCRIPTION OF THE PREFERRED EMBODIMENT

Figure 1:
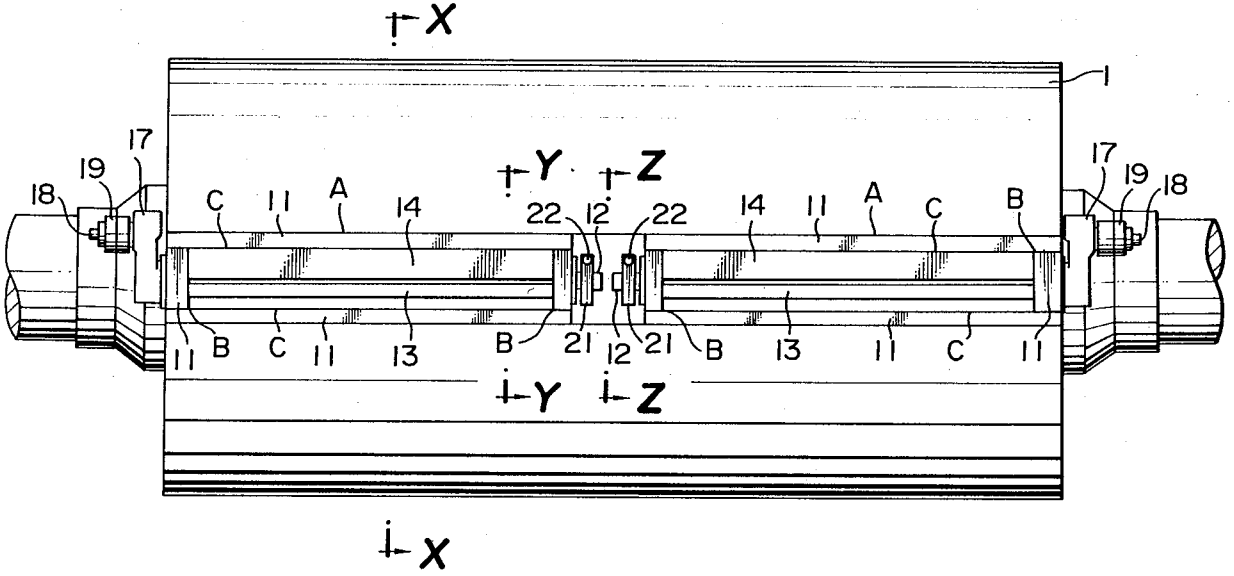
FIG. 1 is an elevational view showing one embodiment of the jaw folding device for a jaw cylinder of a jaw-type folder according to the present invention.
Figure 2:
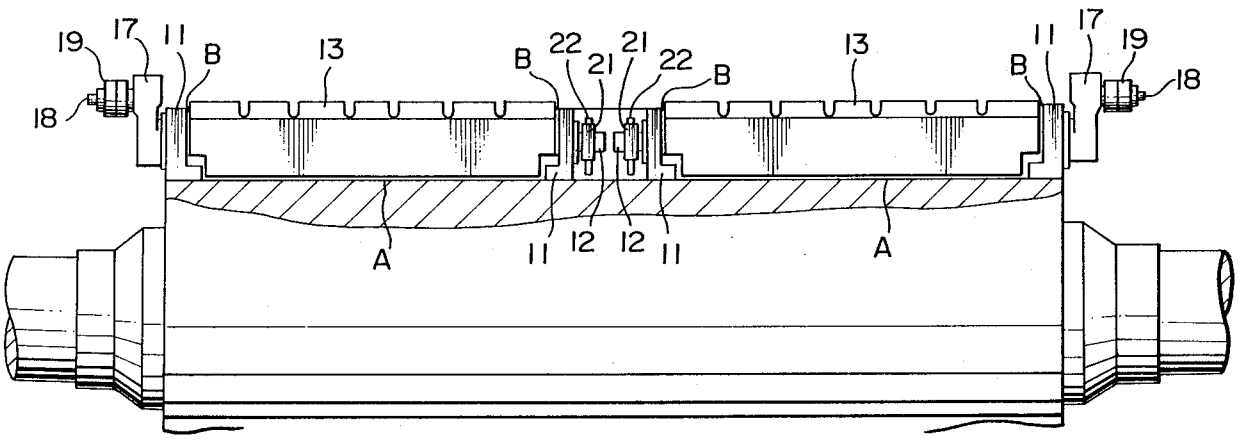
FIG. 2 is a schematic partially sectional view showing the side of FIG. 1.
Figure 3:
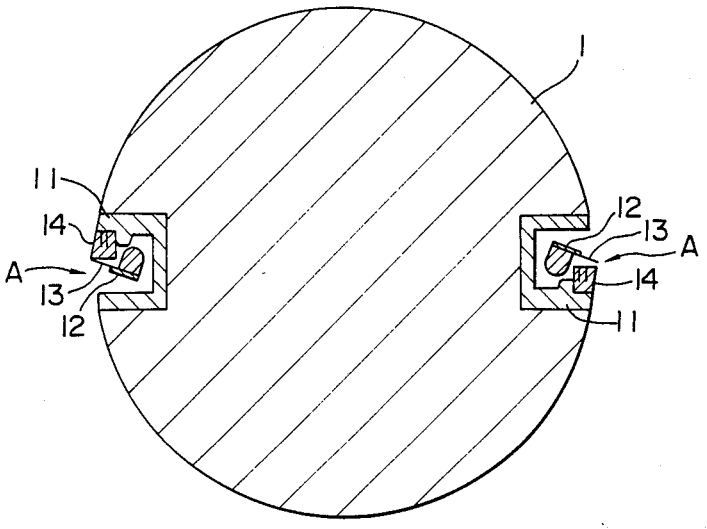
FIG. 3 is a cross sectional view taken along the line X—X in FIG. 1.

Referring to FIGS. 1 to 7, there is shown a preferred embodiment of the present invention. In the drawings, the reference numeral 1 denotes a jaw cylinder. This cylinder 1 is formed with a pair of grooves A which are arranged in parallel to the longitudinal axis of the cylinder 1. Further, they are symmetrically positioned relative to each other about the axis as shown in FIG. 3. The grooves A are respectively provided with a jaw folding device.

Figure 4:
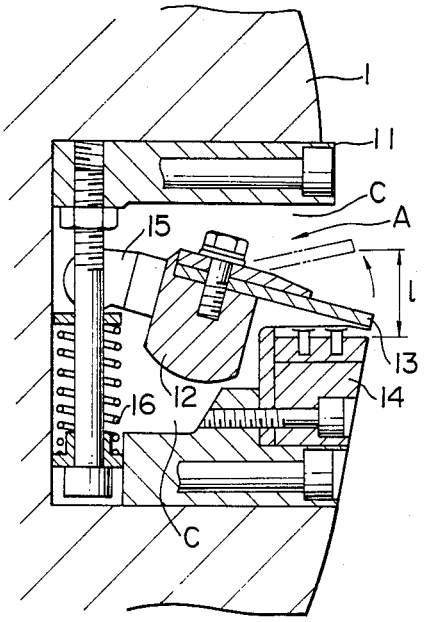
FIG. 4 is a cross sectional view taken along the line Y—Y in FIG. 1, showing a detailed section of the jaw folding device.

A structure o this jaw folding device will be discussed on only one device since they are essentially similar to each other. In detail, the jaw folding device comprises a pair of female members 11 fit within the groove. Each female member 11 contains a controllable jaw plate shaft 12 which is rotatably supported by bearings, not shown in the drawings, fixed to both end walls B of the female member 11. A controllable jaw plate 13 is fixed on the shaft 12 in its longitudinal direction. On the other hand, a fixed jaw plate 14 is also fixed to one of longitudinal edges C of the female member 11. Further the controllable jaw plate shaft 12 is provided with an arm 15 for receiving a spring. This arm 15 is located near the center of the cylinder 1 and protrudes towards its axis as shown in FIG. 4. In the groove A an urging means 16 is set between the inner walls of the female member 11. This urging means 16 engages with the arm 15 and urges the controllable jaw plate shaft 12 through it so as to compress the controllable jaw plate 13 to the fixed jaw plate 14.

As shown in FIGS. 1 and 2 an actuating arm 17 is respectively fixed to the external end of the shaft 12. This actuating arm 17 is further integrally formed with a cam-follower shaft 18 protruding outwards. On this shaft 18 a cam-follower 19 is rotatably mounted and arranged so as to always contact to a cam, not shown in the drawings, which is mechanically connected to a base machine, not shown.

A fixing means 20 is fixed to the internal end of the shaft 12. This fixed position is not only limited to this end, but may be also fixed to any proper position of the shaft 12. The fixing means 20 is composed of a block member 21 fixed to the shaft 12 and a rod 22. The block member 21 contain an opening in which a female screw is formed. The rod 22 is formed with a male screw, and threadingly engaged within the opening. Further, two stoppers 23 and 24 are secured to respective ends of the rod 22 as shown in FIG. 5.

Figure 6:
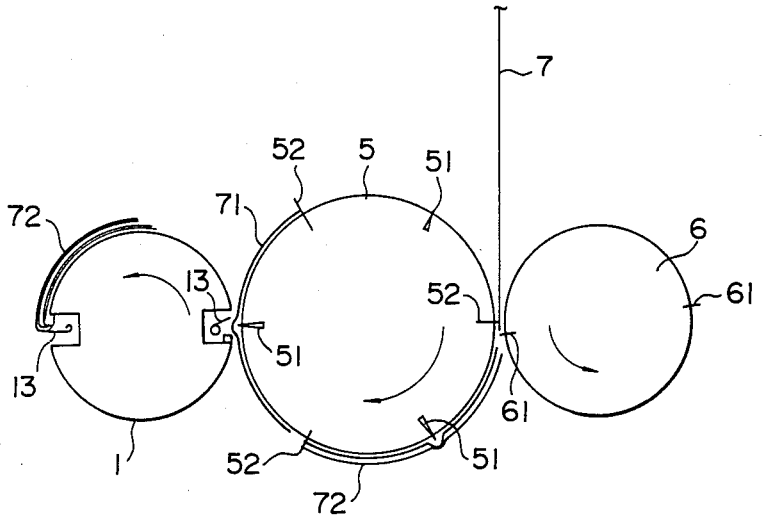
FIG. 6 is a schematic illustration showing the jaw folding operation of the jaw folding device for a jaw cylinder of jaw-type folder according to the present invention under the correct run mode.
Figure 7:
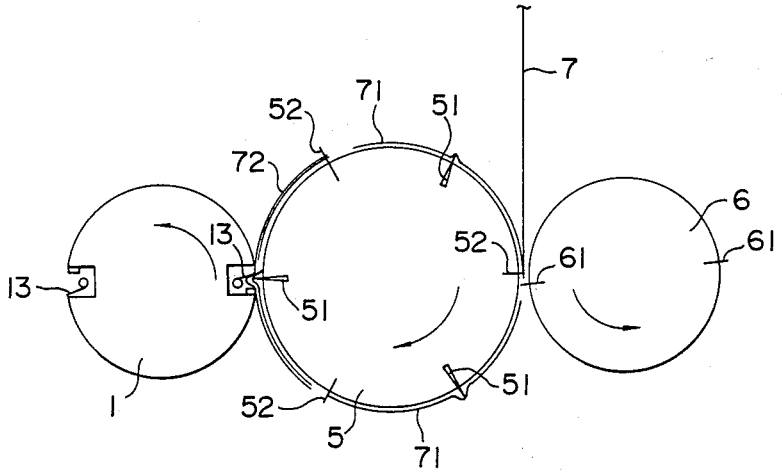
FIG. 7 is a schematic illustration showing the state that the jaw cylinder has been revolved at an angle of 180°.

Referring to FIGS. 6 and 7, there is shown a combination of the jaw cylinder 1, a folding cylinder 5 and a cutter cylinder 6. The folding cylinder 5 is interposed between the jaw cylinder 1 and the cutter cylinder 6. The folding cylinder 5 contains a folding blade 51 and a needle 52. A paper 7 is fed between the folding cylinder 5 and the cutter cylinder 6, and then cut into a section; that is, firstly cut section is represented by a first section 71 and succeedingly cut is a second section 72.

An operation of such constituted device will be explained as follows.

Figure 5:
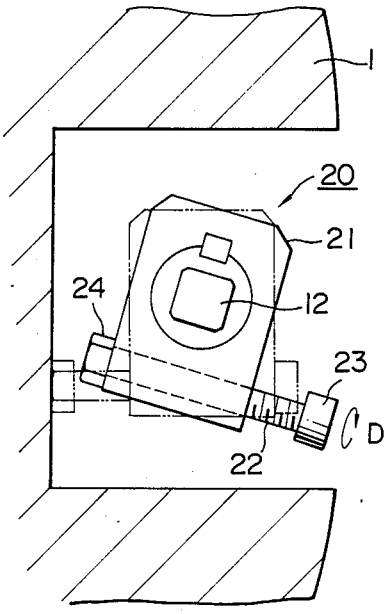
FIG. 5 is a cross sectional view taken along the line Z—Z in FIG. 1, showing the fixing means for the jaw folding device in detail.

In order to drive under the correct run mode, the rod 22 is turned in the clockwise direction represented by the arrow D shown in FIG. 5 so as to actuate the fixing means 20 for one of the jaw folding devices symmetrically arranged in the jaw cylinder 1. According to this turning, the rod 22 is moved towards the bottom of the groove A and thus the stopper 23 contacts to the block member 21, so that the fixing means 20 is shifted into its fixing position represented by the phantom line shown in FIG. 5. On this occation the urging means 16 applies its urging force to the controllable jaw plate shaft 12 through the arm 15. Though, the stopper 24 of the fixing means 20 contacts to the bottom of the groove A and prevents the shaft 12 to change its angle further. The controllable jaw plate 13 and the fixed jaw plate 14 keep on isolating each other. The isolated distance l between the plates 13 and 14 is at least the thickness of the section which is jaw-folded therebetween. Preferably, the isolated distance is enlarged to the degree that the cam follower 19 fixed to the external end of the shaft 12 does not interfere with the cam, not shown in the drawings.

The other fixing means is kept in its non-fixing position corresponding to the state represented by the solid line in FIG. 5. In order to keep this non-fixing position, the rod 22 is revolved in the counter clockwise direction so as to contact the stopper 24 to the block member 21. As the rotary press, not shown, is revolved, this fixing means is also actuated. In detail, the cam follower 19 fixed to the external end of the shaft 12 follows the external surface of the cam, not shown. The shaft 12 is forcibly revolved within a certain angle against the urging force of the urging means 16. According to this revolving motion, the controllable jaw plate 13 swings and acts as a jaw with the fixed jaw plate 14. Thus, they pick up the section protruded from the folding blade 51 and then fold this picked section.

On the other hand, the jaw folding device whose fixing means 20 shifted in its fixed position keeps the controllable jaw plate 13 isolating from the fixed jaw plate 14, so that the section on the folding cylinder 5 is not picked up by the jaw folding device. The section remains on the revolving cylinder 5. This remained section is lapped with the succeeding one.

In order to carry out under the straight run mode, all the fixing means 20 in the jaw cylinder 1 are free from their fixing position by adjusting the rod 22. All the jaw folding devices can perform jaw folding operation as the section is protruded from the folding blade 51 of the folding cylinder 5.

To facilitate for adjusting the rod 22, the shaft 12 is preferably formed with means to which a tool can be fit for previously angular-shifting the shaft 12 so as to isolate the controllable jaw plat.e 13 from the fixed jaw plate 14. In this embodiment, the shaft 12 is formed in a rectangular section as shown in FIG. 5. Accordingly, the stopper 24 can be easily contacted to the bottom of the groove A formed in the cylinder 1.

Although in this embodiment two jaw folding devices set in the jaw cylinder are similarly constituted, the present invention is not limited to this configuration. For example, the same effect can be obtained when an even number of the jaw folding devices are set and half of them are conventional type devices; i.e., without the fixing means. Also the fixing means 20 is not limited to the combination between the block member 21 formed with the female screwed opening and the male screwed rod 22, any well known easily coupling mechanism such as Bayonet connection or the like can be used for such rod and block member in order to facilitate for adjusting and fixing the rod.

Although the invention has been described in its preferred form with a certain degree of particularity, it is understood that the present disclosure of the preferred form has been changed in the details of construction and arrangement of parts may be resorted to without departing from the spirit and the scope of the invention as hereinafter claimed.

What is claimed is:

1. A jaw folding device for a jaw cylinder of a jaw-type folder comprising:

a controllable jaw plate secured to a controllable jaw plate shaft;

a female member on the jaw cylinder, a fixed jaw plate arranged on the jaw cylinder acting as a co-operating male member so as to face said controllable jaw plate, said fixed jaw plate being attached to an interior edge of said female member;

means for synchronously actuating said controllable jaw plate shaft to urge said controllable jaw plate between an open position, wherein said controllable and fixed jaw plates are positioned apart from each other, and a closed position, wherein said fixed and controllable jaw plates are brought together to grip a workpiece; and means for fixing said controllable jaw plate in said open position such that said controllable jaw plate is fixed relative to said fixed jaw plate, thereby preventing a workpiece from being gripped therebetween.

2. A jaw folding device for a jaw cylinder of a jaw-type folder comprising:

a controllable jaw plate secured to a controllable jaw plate shaft;

a female member on the jaw cylinder, a fixed jaw plate arranged so as to face said controllable jaw plate, said fixed jaw plate being attached to said female member;

means for actuating said controllable jaw plate between an open position and a closed position in synchronism; and means for fixing said controllable jaw plate in said open position such that said controllable jaw plate is fixed relative to said fixed jaw plate, thereby preventing a workpiece from being gripped therebetween wherein said fixing means comprises a block member fixed to said controllable jaw plate shaft, said block member having a threaded opening;

a threaded rod, which is threadingly engaged within said threaded opening of said block member; and a pair of stoppers each being fixed to an end of said rod, wherein said rod is rotated so as to contact one of said stoppers with a surface of the female member when said controllable jaw plate is fixed in said open position.

3. A jaw folding device for a jaw cylinder of a jaw-type folder comprising:

a controllable jaw plate secured to a controllable jaw plate shaft;

a female member on the jaw cylinder, a fixed jaw plate arranged so as to face said controllable jaw plate, said fixed jaw plate being attached to said female member;

means for actuating said controllable jaw plate between an open position and a closed position in synchronism wherein said actuating means further comprises an arm disposed at an end of said controllable jaw plate shaft which is opposite said controllable jaw plate, means for urging said controllable jaw plate in a direction towards said fixed jaw plate, and said arm communicating with said urging means; and means for fixing said controllable jaw plate in said open position such that said controllable jaw plate is fixed relative to said fixed jaw plate, thereby preventing a workpiece from being gripped therebetween.

* * * * *